US008439773B2

(12) United States Patent
Silagy

(10) Patent No.: US 8,439,773 B2
(45) Date of Patent: May 14, 2013

(54) BASKETBALL SHOOTING TARGET

(76) Inventor: Howard Silagy, Pawcatuck, CT (US)

( * ) Notice: Subject to any disclaimer, the term of this patent is extended or adjusted under 35 U.S.C. 154(b) by 94 days.

(21) Appl. No.: 13/085,229

(22) Filed: Apr. 12, 2011

(65) Prior Publication Data

US 2011/0263356 A1 Oct. 27, 2011

Related U.S. Application Data

(60) Provisional application No. 61/327,760, filed on Apr. 26, 2010.

(51) Int. Cl.
*A63B 69/00* (2006.01)
*A63B 63/08* (2006.01)

(52) U.S. Cl.
USPC ..... 473/447; 473/480; 473/485; 473/422

(58) Field of Classification Search ..... 473/422, 473/447, 472, 479, 480, 522
See application file for complete search history.

(56) References Cited

U.S. PATENT DOCUMENTS

| | | | | | |
|---|---|---|---|---|---|
| 4,244,569 | A | | 1/1981 | Wong | |
| 4,506,886 | A | | 3/1985 | Lamb, Sr. | |
| 4,915,381 | A | | 4/1990 | Hackett | |
| 4,927,143 | A | * | 5/1990 | Hillock | 473/522 |
| 5,064,195 | A | * | 11/1991 | McMahan et al. | 473/480 |
| 5,390,912 | A | | 2/1995 | Silagy | |
| 5,458,325 | A | * | 10/1995 | Klein et al. | 473/485 |
| 5,800,290 | A | * | 9/1998 | Barry | 473/438 |
| 5,813,928 | A | * | 9/1998 | Hsieh | 473/480 |
| 6,190,270 | B1 | * | 2/2001 | Barry | 473/438 |
| 6,322,460 | B1 | * | 11/2001 | Asci | 473/422 |
| 7,014,579 | B1 | * | 3/2006 | Sung | 473/522 |
| 7,553,245 | B2 | * | 6/2009 | Dones | 473/485 |
| 7,942,763 | B2 | * | 5/2011 | Zaccaria | 473/447 |
| 8,197,362 | B1 | * | 6/2012 | Johnson | 473/447 |
| 2007/0135238 | A1 | * | 6/2007 | Dones | 473/447 |
| 2007/0135239 | A1 | * | 6/2007 | Manix et al. | 473/448 |

* cited by examiner

*Primary Examiner* — Mitra Aryanpour
(74) *Attorney, Agent, or Firm* — Barlow, Josephs & Holmes, Ltd.

(57) ABSTRACT

The invention is directed to a novel and unique basketball shooting target removably connected to a basketball goal. The target is an object that includes a female member having a female member core and female outer layer and a male member having a male member core and male outer layer. The female member core includes female lock flanges and female contact surfaces for engaging the male member core. The male member core has buttons that each includes respective cam locks configured for releasable engagement with female lock flanges on a female core to prevent horizontal movement. The male member core has male contact surfaces for engaging the female contact surfaces of the female member to prevent vertical movement. In operation, the male and female members removably connect with one another to engage a netting of a basketball goal and prevent movement relative to one another in horizontal or vertical direction.

9 Claims, 22 Drawing Sheets

BASKETBALL SHOOTING TARGET

CROSS REFERENCE TO RELATED APPLICATION

This application is related to and claims priority from earlier filed provisional patent application Ser. No. 61/327,760, filed Apr. 26, 2010, the entire contents thereof is incorporated herein by reference.

BACKGROUND OF THE INVENTION

The present invention relates to improvements in a basketball shooting target, the improvements more particularly enabling the use of the target under actual game conditions to thereby place the user under the pressure of a defending opposing player and correspondingly contributing to enhancing proficiency during more realistic and meaningful circumstances.

It is already well known to use a sighting target to teach the proper trajectory for a basketball shot, the attached association of the target to the basketball hoop taking various forms as exemplified by U.S. Pat. No. 4,244,569 issued to Wong for "Basketball Practicing Apparatus" on Jan. 13, 1981, U.S. Pat. No. 4,506,886 issued to Lamb Sr. for "Basketball Practice Apparatus" on Mar. 26, 1985, and U.S. Pat. No. 4,915,381 issued to Hackett for "Basketball Target Device" on Apr. 10, 1990.

Applicable to the above referenced, and all known basketball shooting targets, and using the Hackett basketball target of FIG. 1 by way of a specific example, the target is located centrally of the circular rim of the basketball hoop structure, and is presented in a bright color to serve as a visual sighting device for enhancing the proficiency of a scoring basketball shot delivered in a trajectory for passage through the rim. The location specifically selected to be central of the circular rim is consistent with an effort to teach the noted trajectory shot from all angles relative to the target, i.e. from opposite corners of the court, center court, etc., thus, according to the prior art practice, obviating any need to change the target location since it is at the center of the rim and in this location thought to be appropriate as a sighting target no matter where on the playing court the trajectory shot originates from.

Using the prior art target 10 of FIG. 1 mounted centrally in the area bounded by the rim 14 is consistent with the concept that it function as a visual sighting object from all angles relative thereto, i.e. from opposite corners of the basketball court, counter court, etc., for a "swish" shot. However, and as illustrated in phantom perspective in FIG. 1, other varieties of shots, known in basketball parlance as a short jump shot, depicted by reference numeral 20, and even more significantly a so-called "dunk" shot in the execution of which the basketball 22 is forced through the net 18 with a manual thrust, depicted by the reference numeral 24, are obviously impeded by the rim opening-blocking position of the target ball 10. Resiliency of the cord 12 does not obviate entanglement with the user's hand executing the manual thrust 24 of a "dunk" shot.

Underlying the present invention is the recognition that proficiency in making a basketball trajectory score is not demonstrated unless acquired under game pressure when an attempt is of course being made to prevent the score. The prior art practice targets or devices using a rim centrally located sighting target are appropriate only for non-game practice sessions, and thus are inadequate in the important respect noted.

U.S. Pat. No. 5,390,912, invented and owned by current Applicant, addressed some of the issues above in the prior art. Referring to FIGS. 2-4, the '912 patent disclosed using plastic balls, designated 30 in FIG. 3, supported 3-4 inches below the rim 32, as in FIG. 4, on a cooperating strand 34 of the net 36, and by reason of its support position on the net being necessarily in a clearance position in relation to a central path through the rim 32 and the net 36 strung in depending relation about the rim 32. Each target ball 30 is of plastic construction material formed as two half spheres 44 and 46, the inner diameters being sized to provide a friction fit when closed upon each other. Prior thereto, however, a two-piece pin 50 is engaged to a cooperating net strand 34 at the site 52 so that opposite ends of the pin 50 project into hollow cylindrical tubes 54 integral with spheres 44, 46 during the closing together or interfitting connection of the spheres. In reference to FIG. 2, the target balls 30A, 30C, and 30E are positioned on the far side of the net 36, from the perspective of the shooter, so that ball 30A is a visual target for a right corner shot originating from the area 38, ball 30C for a center court shot from area 40, and ball 30E for left corner shot from area 42. However, there is still a need to improve upon the invention of the '912 patent.

In light of the prior art, there is a need to be able to locate a basketball-aiming target in a desired location that optimizes training and practice.

In addition, there is a need to be able to effectively attach such a target in the desired location to achieve such optimized training and practice.

There is also a need for a target to be able to be easily and quickly attached and removed from its desired location yet be rugged and durable for extended use over time.

There is also a need for a basketball shooting target that does not accidentally detach during use.

There is a further need for a basketball shooting target that is rugged and that can be attached and detached for extended enjoyment and use over time.

SUMMARY OF THE INVENTION

The present invention preserves the advantages of prior art basketball shooting targets and methods related thereto. In addition, it provides new advantages not found in currently available shooting targets and methods and overcomes many disadvantages of such currently available shooting targets and methods.

The present invention is a basketball shooting target removably connected to a basketball goal, namely, the netting thereof in an optimal location to improve basketball shooting efficiency and skill. The basketball shooting target is used for aiming a basketball through a basketball goal. The target is configured for removably connecting around a strand or yarn of a netting of the basketball goal. The target defines a first aperture for entering the strand into the target and a second aperture for exiting the strand from the target. The target defining a channel running an entire length of the target from the first aperture to the second aperture. Upon connecting the target to the strand, the strand routes through an entire length of the target wherein a portion of the strand resides. The target is positioned at a specific location on the netting to provide a basketball-aiming target for training purposes.

The target for aiming a basketball through a basketball goal is multi-layered and, in one example, defines a spherical shape. The multi-layer target includes a core and an outer layer having one or more cushioning layers. The outer layer may include a first cushioning layer made of polyurethane material that is lightweight. A second cushioning layer may include a rubber composition made of resilient material. The cushioning layers reduce damage to incoming basketballs and deaden the sound of the associated impact.

The target for aiming a basketball through a basketball goal includes a female member and a male member, which are configured for being removably connected to one another. The female member has a female member core and a female outer layer. The female member core has one or more female lock flanges for preventing horizontal movement of the female member upon engaging the male member.

The female member core has one or more female contact surfaces defining a triangular shape to prevent vertical movement of the female member engaging the male member. The female outer layer has one or more cushioning layers on an outer surface of the female member core.

The male member has a male member core and a male outer layer. The male member core has one or more spring-biased button members slidably connecting within one or more opposing ends of the male member. The button members include one or more cam locks configured for releasable engagement with the female lock flanges to regulate horizontal movement of the male member relative to the female member. The button members are configured to be depressed to move the cam locks relative to one another to engage or disengage the female lock flanges to regulate the horizontal movement of the male member to the female member. Upon the cam locks disengaging from the female lock flanges, the male member is allowed to horizontally move apart from the female member. Once the female lock flange clears the cam locks of the male member, the male and female members are allowed to move both vertically and horizontally relative to one another.

The male member core has contact surfaces preferably defining a triangular shape for engaging the female contact surfaces of the female member to prevent vertical movement of the male member when engaged with the female member. The male outer layer having one or more cushioning layers on an outer surface of the male member core.

A channel defining through an entire length of the male and female member is configured to receive a strand of the netting of a basketball goal. The male and female members are connected together around the strand to secure the netting within the channel and prevent movement of the basketball shooting target relative to the netting until the button locks are depressed.

In operation, the male and female members removably connect with one another to engage the strand of the netting within the channel and prevent movement relative to one another in horizontal or vertical direction until the button locks are depressed, namely preferably depressed in a direction toward each other.

The present invention includes a method for improving basketball shooting accuracy of a basketball through a netting of a basketball goal. To start, a target is provided which is configured for removably connecting around a strand of the netting and routing the strand through an entire length of the target. For example, the target may be the basketball shooting target as described herein. Next, the target is positioned on the netting of the basketball goal at a specified location. The target is connected around the strand, which is routed through the entire length of the target. In operation, the target engages the strand of the netting for aiming purposes to assist a basketball shooter in more accurately guiding the basketball through the basketball goal. In fact, the device of the present invention can be attached to any portion of the netting that is desired by the user. The preferred location is discussed below although the present invention is not limited to such location.

Accordingly, an object of the present invention is to provide a basketball-aiming target in a desired location that optimizes training and practice for basketball trajectory shooting.

A further object of the present invention is the provision for a basketball shooting target to be removably connected to a netting of a basketball goal to achieve such optimized training and practice.

There is an object of the present invention to provide a basketball shooting target that can be easily attached and removed from its desired location yet be rugged and durable for extended use over time.

In yet another object of the present invention is the provision for a basketball shooting target that does not detach during use.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the basketball shooting target and methods are set forth in the appended claims. However, the basketball shooting target and methods, together with further objects and attendant advantages, will be best understood by reference to the following detailed description taken in connection with the accompanying drawings in which:

DETAILED DESCRIPTION OF PREFERRED EMBODIMENT

Referring to FIGS. 5-24, a basketball shooting target 10 of the present invention is shown. The invention is generally directed to a novel and unique basketball shooting target 10 that can be removably connected to a basketball goal, namely, the netting thereof in an optimal location to improve basketball shooting efficiency and skill. The constructions of the embodiment of FIGS. 5-24 shows a further embodiment that is easy to install and remove and is rugged to withstand hours of practice which is an improvement upon the shooting target of U.S. Pat. No. 5,390,912, invented and owned by current Applicant and incorporated herein by reference.

The present invention provides a structure and configuration to permit the target 10 to be secured to any desired point on the netting in a new and novel way, which may be accomplished in different ways. As will be described below, the target of the present invention can be easily installed or retrofitted to any type of basketball hoop netting, namely, one that is securely lashed in to the rim or one that has loops and installed on hooks on the rim.

Figure 1:
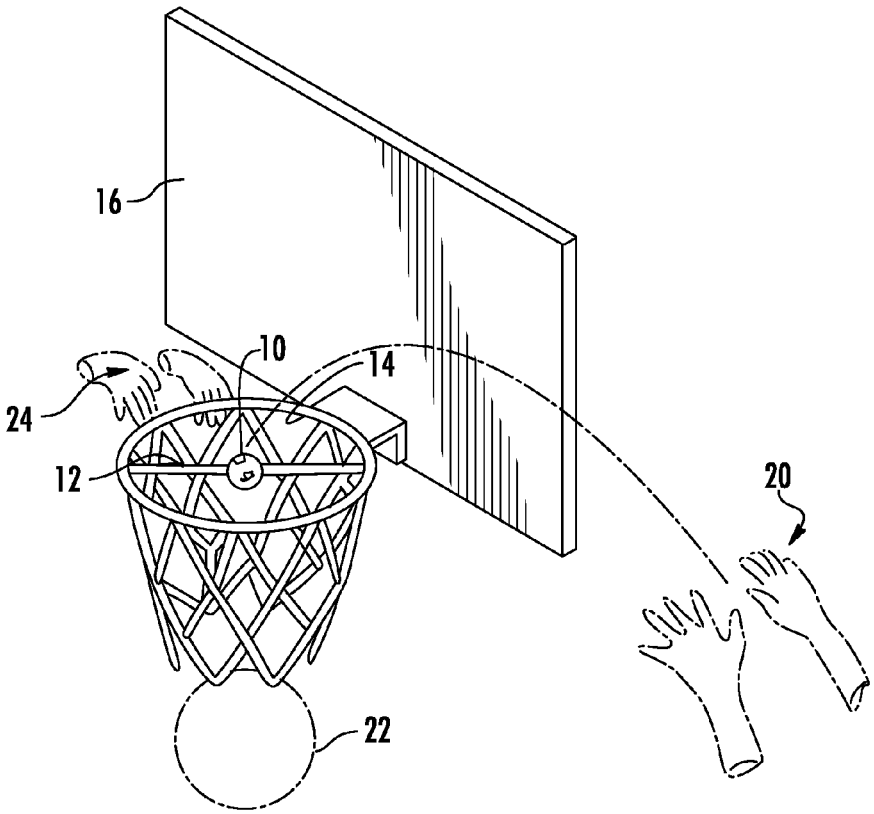
FIG. 1 (PRIOR ART)
FIG. 1 is a perspective view of a prior art basketball shooting target, including illustrations in phantom perspective of exemplary shots denominated in basketball parlance as a "jump shot" and "dunk"
Figure 2:
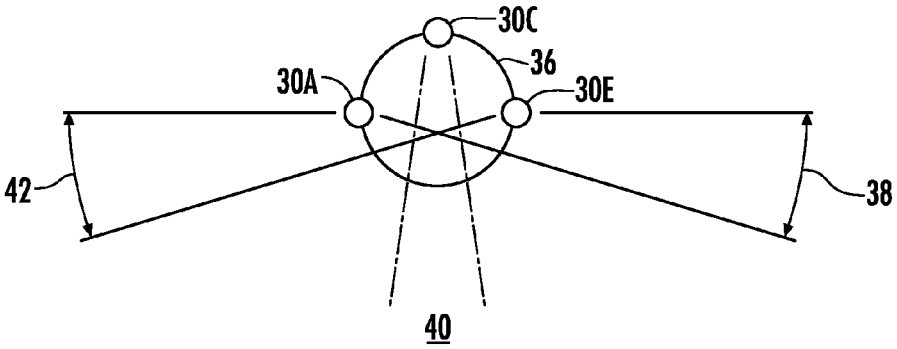
FIG. 2 (PRIOR ART)
FIG. 2 is schematic plan view of the prior art illustrating the origination on the basketball court of so-called "swish" or non-backboard shots using the within basketball shooting or aiming target.
Figure 3:
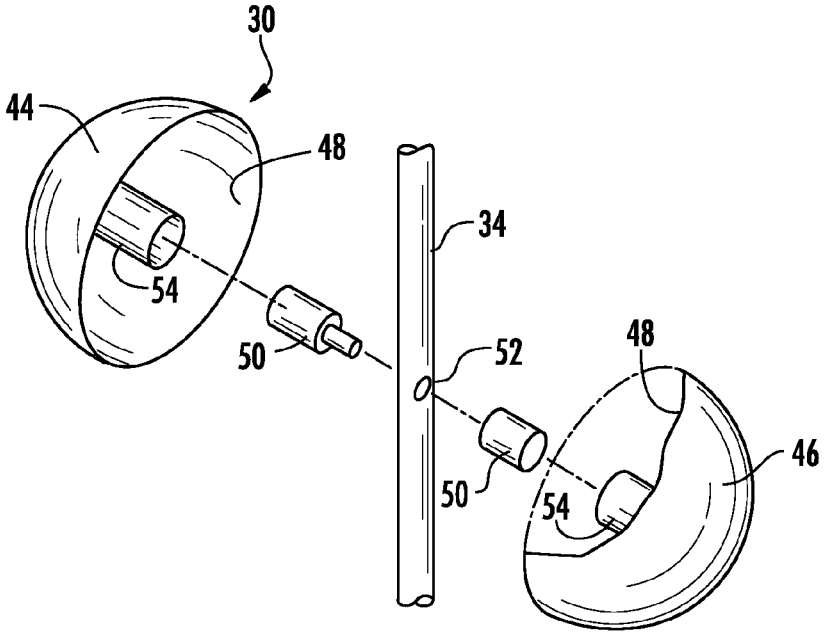
FIG. 3 (PRIOR ART)
FIG. 3 is an exploded view of the prior art, in an enlarged scale, of a ball used as a sighting target.
Figure 4:
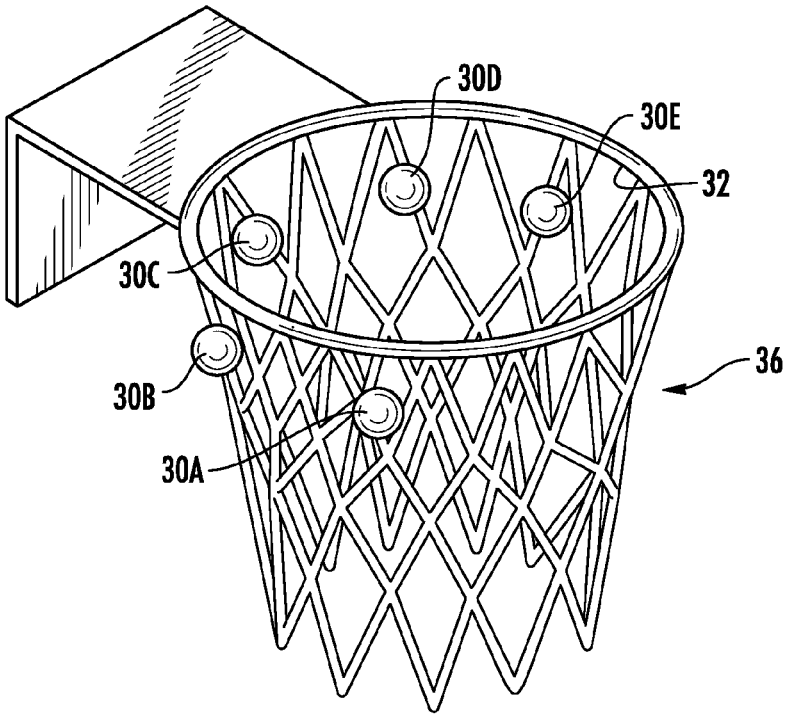
FIG. 4 (PRIOR ART)
FIG. 4 is a perspective view of the prior art of the within aiming device comprised of a selected number, in this case numbering 5, of the target balls of FIG. 3.
Figure 5:
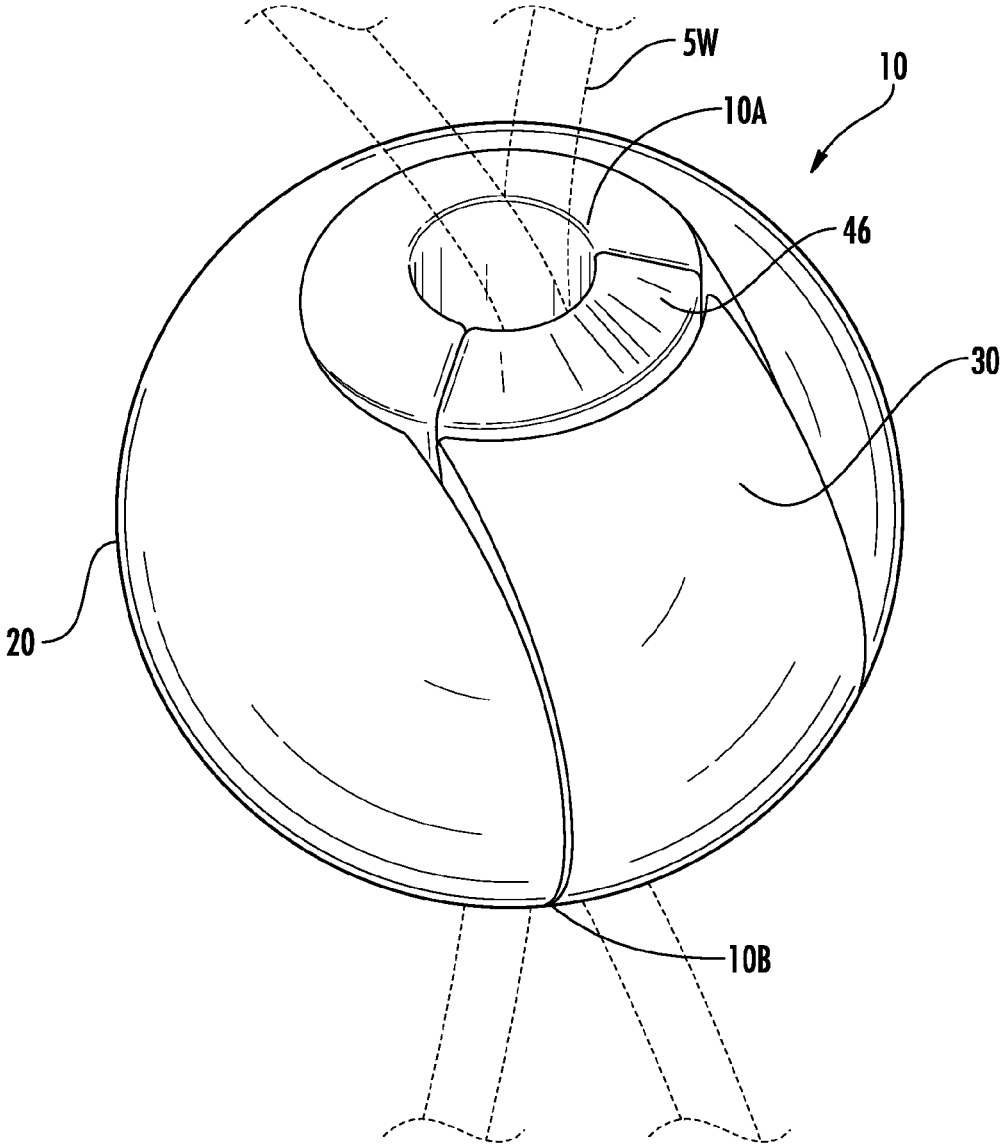
FIG. 5 is a perspective of a basketball shooting target of the present invention having a male member and female member removably connected to one another.
Figure 24:
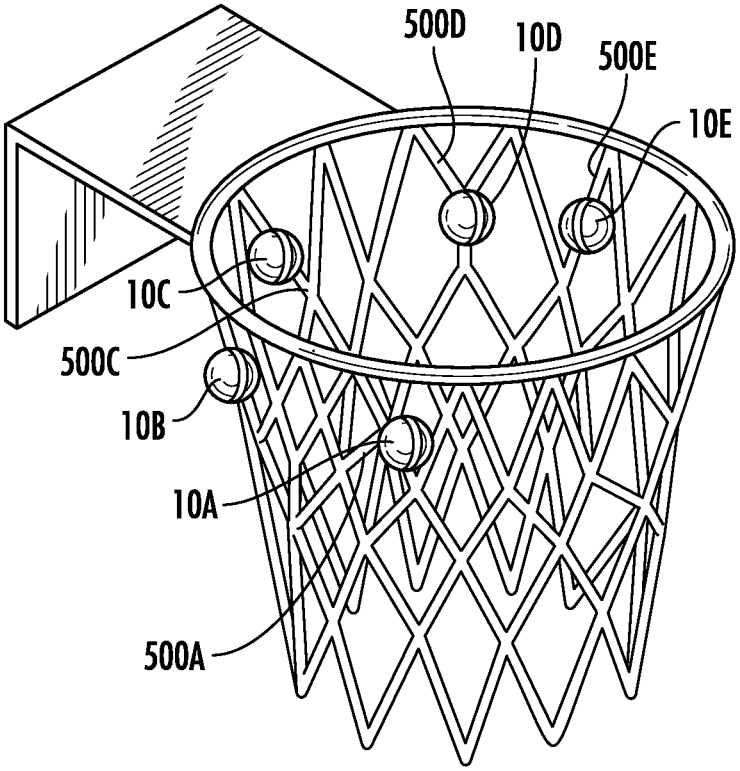
FIG. 24 is a perspective view of the basketball shooting targets of the present invention of FIG. 5 attached to a netting of a basketball goal and having a strand routed through a channel defined with the targets.

The basketball shooting target 10 is used for aiming a basketball through a basketball goal. In FIGS. 5-11, the general construction of the target 10 is illustrated and explained herein. As seen in FIGS. 5 and 24, one or more of target 10 (e.g. 10A-10E) is configured for removably connecting around a strand 500 of the netting (not shown) of the basketball goal (not shown). It is also possible to attach the target 10 about more than one strand 500 if it is desired to locate the target 10 at such a location that is between where a single strand is present. In that case, the target, essentially, can gather two strands 500 together, if such a position and location is preferred.

A female member 20 and male member 30 are provided. The target 10 defines a first aperture 10A for entering the strand 500 into the target 10 and a second aperture 10B for exiting the strand 500 from the target 10. The target 10 defines a channel 20A in the female member 20, and a channel 30A running an entire length of the male member 30 of target 10 from the first aperture 10A to the second aperture 10B. The channels can best be seen in FIGS. 8 and 9. Upon connecting the target 10 to the strand 500, the strand 500 routes through the entire length of the target 10 wherein a portion of the strand 500 resides. The target 10 is positioned at a specific location on the netting to provide a basketball-aiming target for training purposes. In sum, the female member 20 is first embraced about one or more strands 500 at the desired position and then the male member 30 is snapped thereto, as in FIG. 6, to capture the strand or strands 500 therein thereby securing the target 10 in place, where desired.

The target 10 for aiming a basketball through a basketball goal substantially defines a preferably spherical shape, although other shapes may be employed if desired. Of course, the target 10 may have a shape, size, and durability or strength which allows it to be positioned on basketball netting without substantially interfering with the basketball as it passes through the netting while maintaining proper visibility of the target for a basketball shooter at a varied distance. In addition, the strength or durability of the target 10 must be sufficient to prevent undesired dislodging of the target 10 from the netting upon contact with a basketball as it passes through the netting. In a preferred embodiment, the shape of the target 10 is defined as spherical, however, the shape of the target 10 may be defined as a shape other than spherical while maintaining the requirements above with respect to shape, size, and durability.

Figure 6:
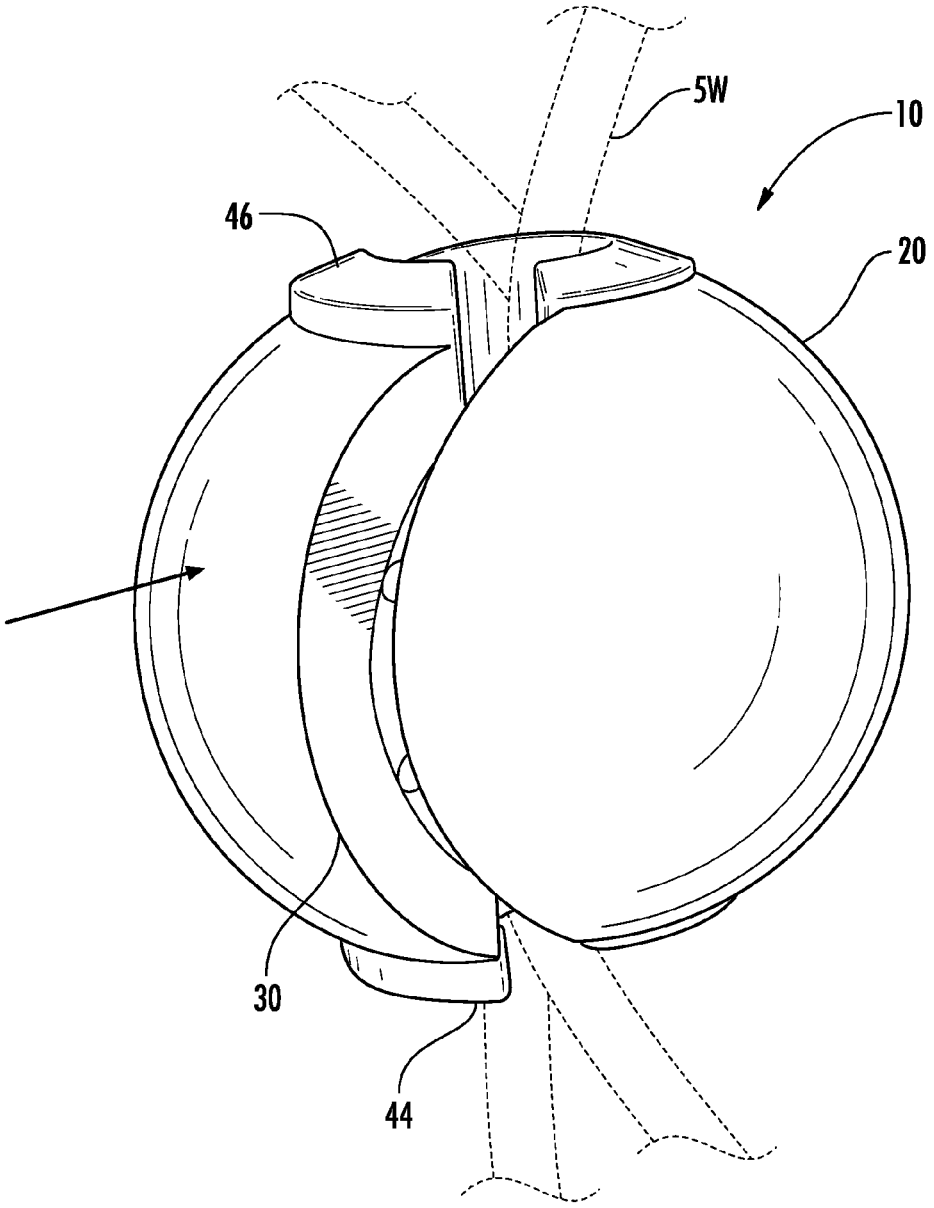
FIG. 6 is a side perspective view of the basketball shooting target of FIG. 5 with a male member in the process of attaching to a female member.
Figure 7:
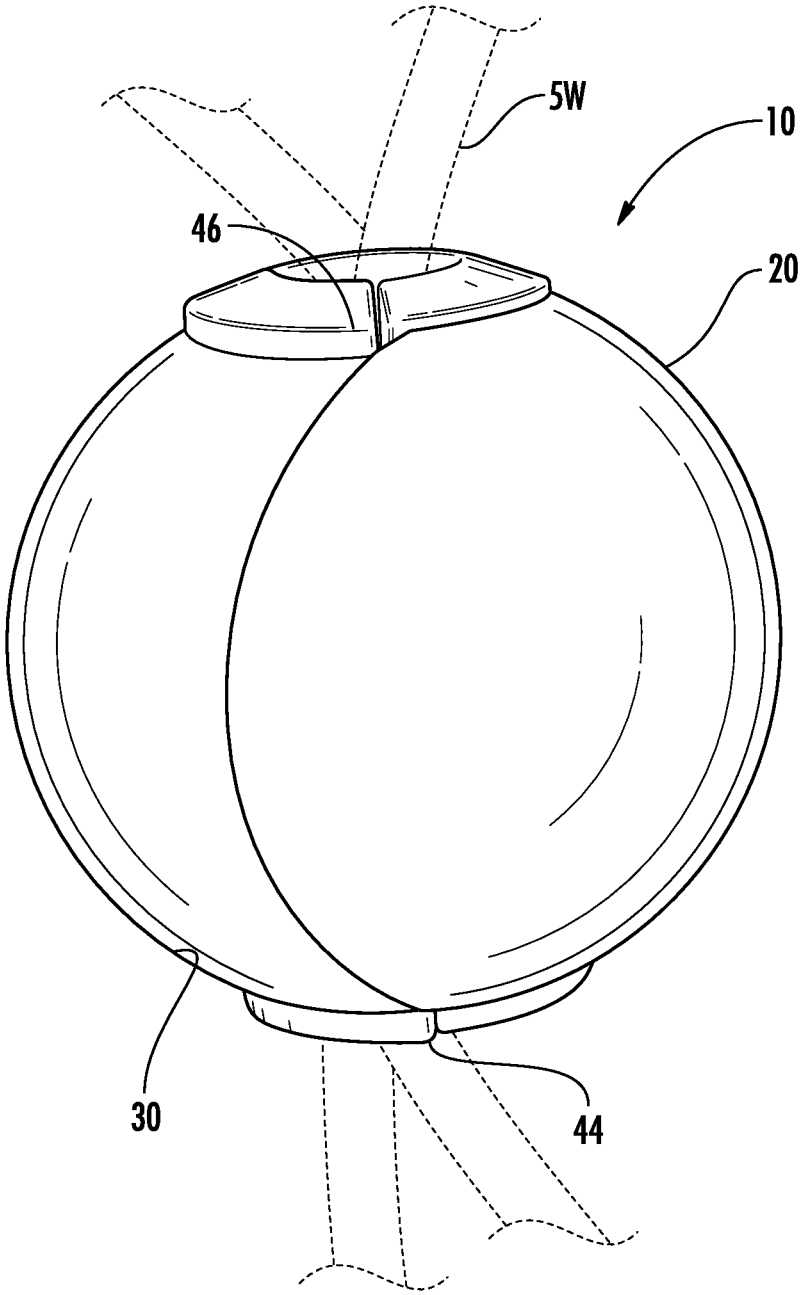
FIG. 7 is a side perspective view of the basketball shooting target of FIG. 5 with the male member connected to the female member.
Figure 8:
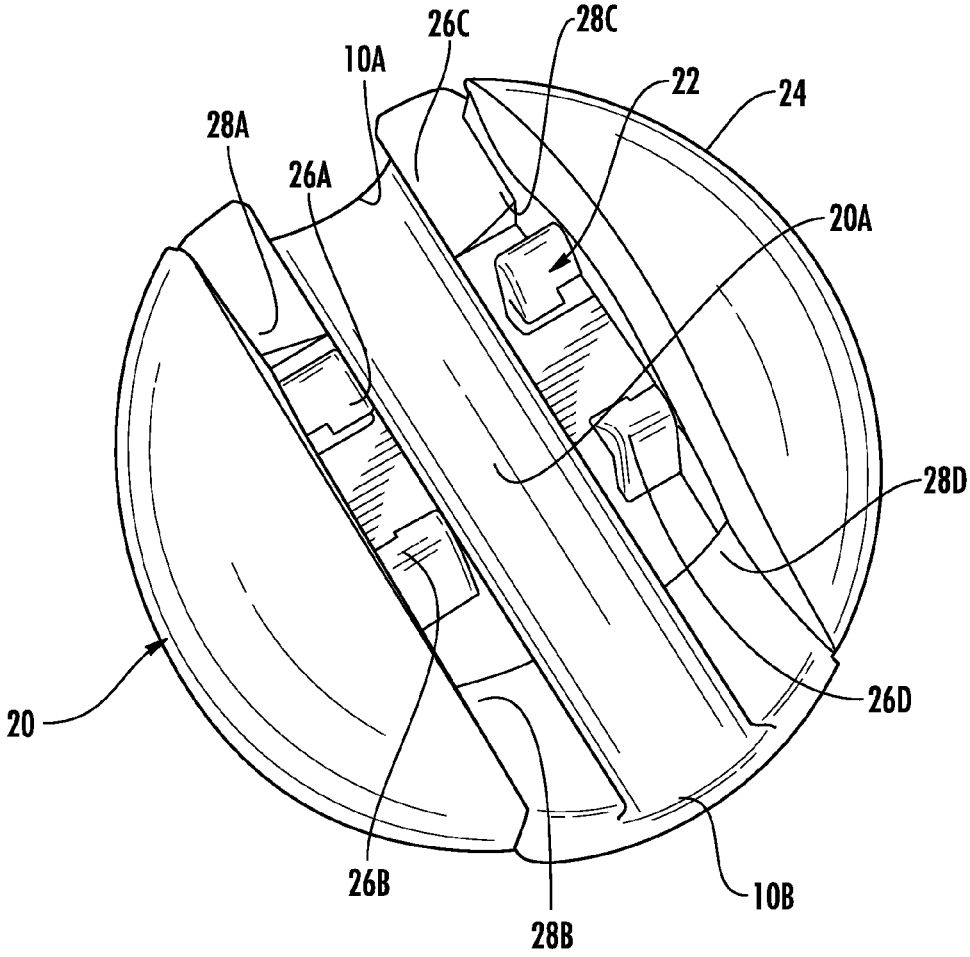
FIG. 8 is a front perspective view of the female member of the basketball shooting target of FIG. 5.

Referring to FIG. 6, the target 10 for aiming a basketball through a basketball goal includes a female member 20 and a male member 30 in the form a removable leaf which are configured for being removably connected to one another. Referring to FIG. 7, the male member 30 snaps into a notch in the female member 20 after the female member 20 has been routed around the desired length of the strand or strands 500 of the netting in the desired location. As illustrated in FIG. 7, the strand 500 is secured by the male member 30 and female member 20 within the channel 20A, 30A running an entire length of the target 10 to lock the target into a specified location on the netting for basketball-aiming purposes.

The female member 20 has a female member core 22 and a female outer layer 24 defining together, at least partially, a spherical shape. Referring generally to FIGS. 8-11, the general mechanism of the invention is illustrated which is explained more fully herein. The female member core 22 has one or more female lock flanges 26A-26D for preventing horizontal movement of the female member 20 upon connecting with the male member 30. The female member core 22 also has one or more female surfaces 28A-26D defining a triangular shape to prevent vertical movement of the female member 20 upon engaging the male member 30.

Figure 9:
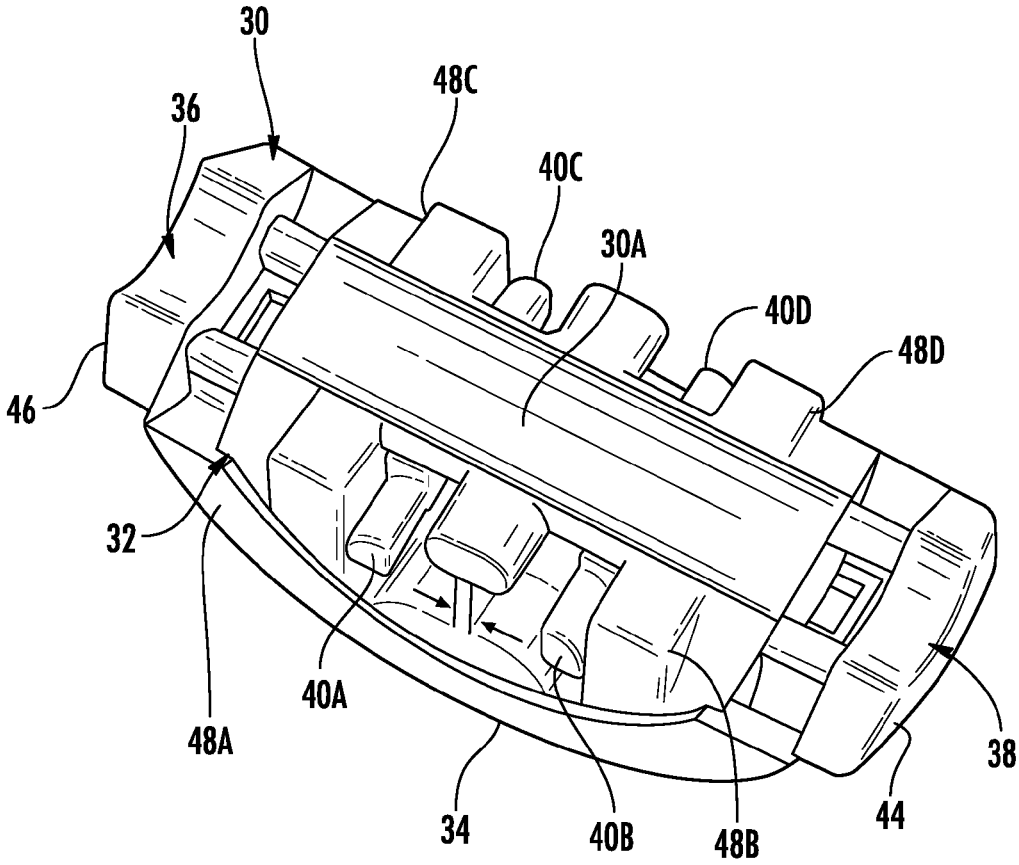
FIG. 9 is a top perspective view of the male member of the basketball shooting target of FIG. 5.

Referring to FIG. 9, the male member 30 has a male member core 32 and a male cushioning layer 34 defining together at least partially, a spherical shape. It should be noted that the male member core 32 and female member core 22 are preferably made of molded plastic, such as polycarbonate and ABS. Of course, the male and female member cores 32, 22 may use other types of relatively lightweight materials for attaching to the netting of a basketball goal.

Figure 10:
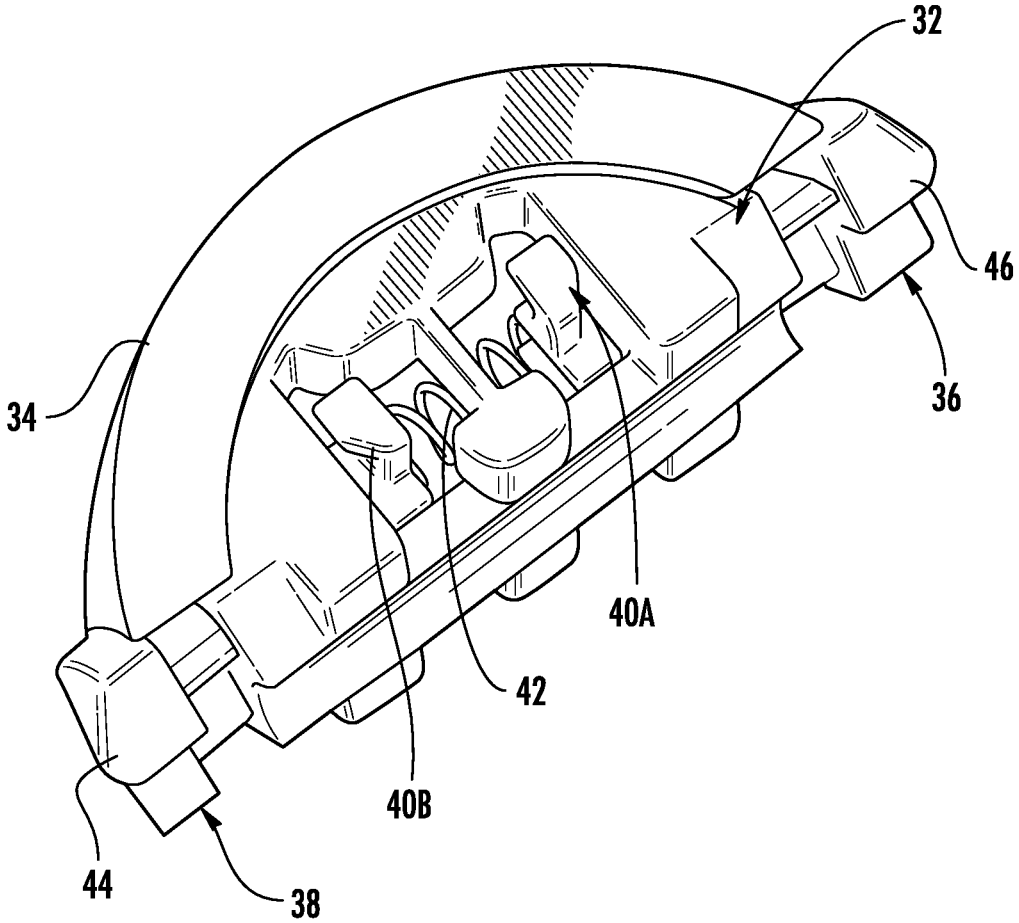
FIG. 10 is a side perspective view of the male member of FIG. 9 with button locks spring-biased into an open position.
Figure 11:
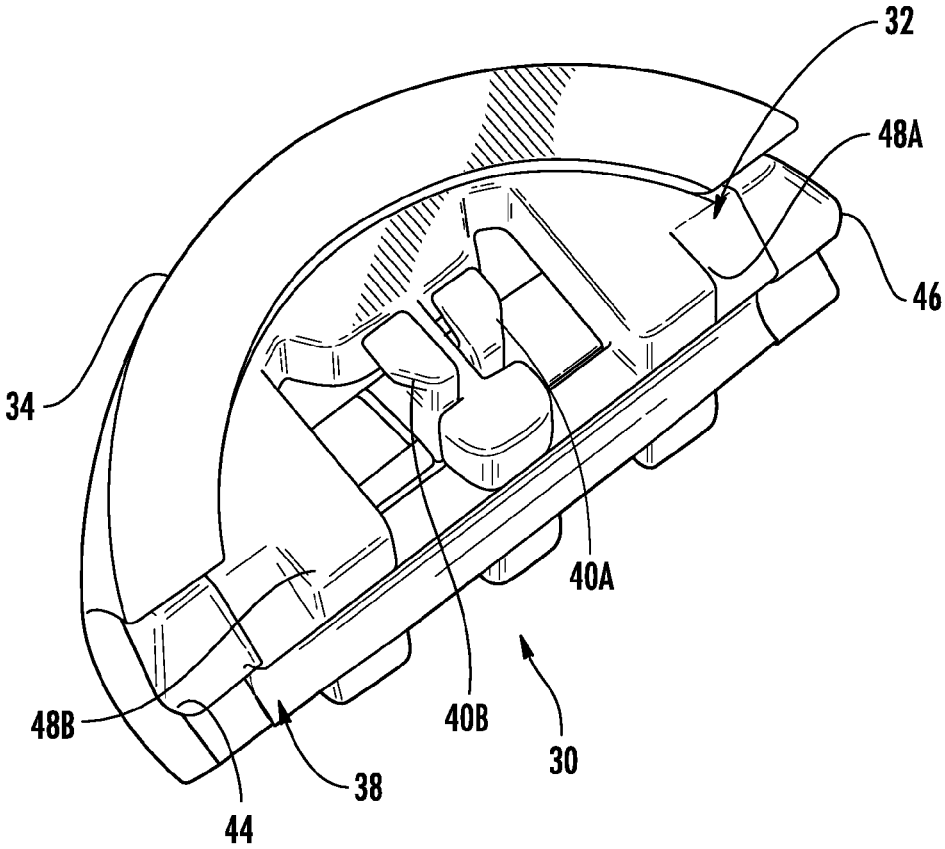
FIG. 11 is side view of the male member of FIG. 9 with the button locks squeezed into a closed position to facilitate attachment and detachment from a female member.
Figure 12C:
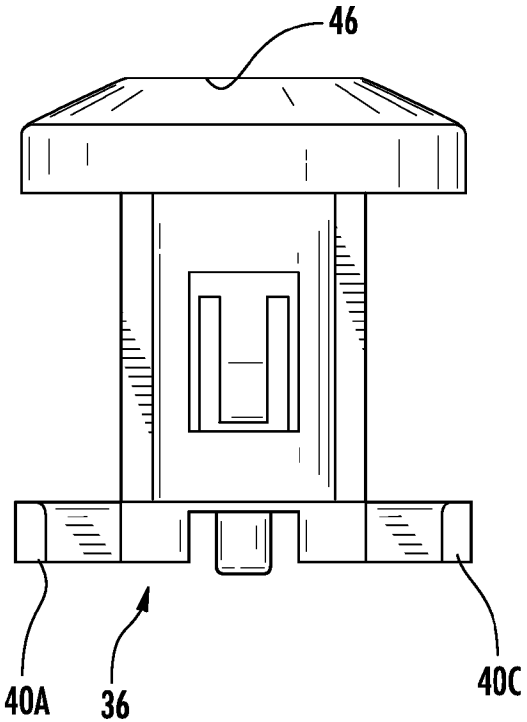
FIG. 12C is a front view of the button member of the male member of FIG. 9.
Figure 12B:
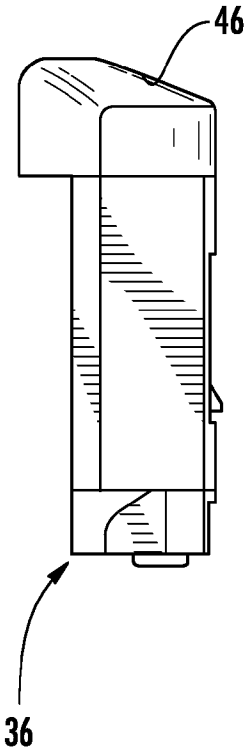
FIG. 12B is a side view of the button member of the male member of FIG. 9.
Figure 12A:
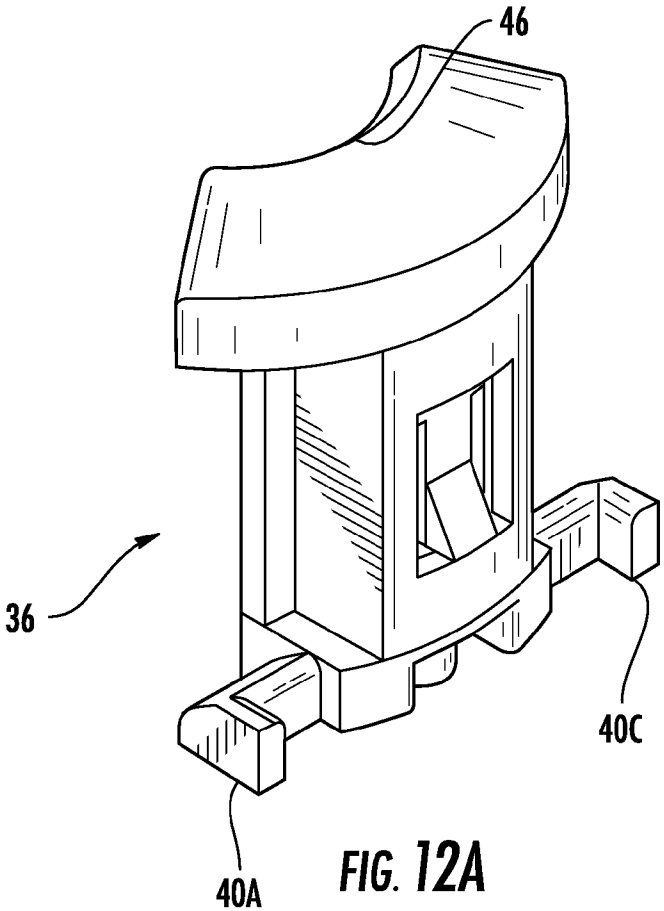
FIG. 12A is a perspective view of one of the button members of the male member of FIG. 9.
Figure 13C:
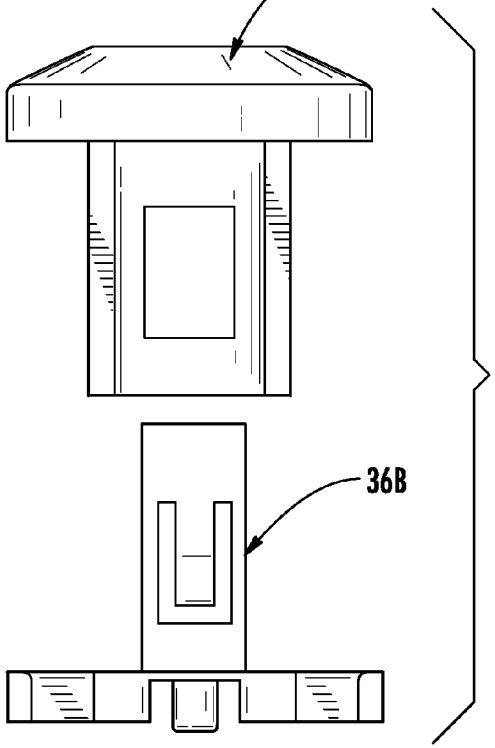
FIG. 13C is an exploded view of the button member of FIG. 12C.
Figure 13B:
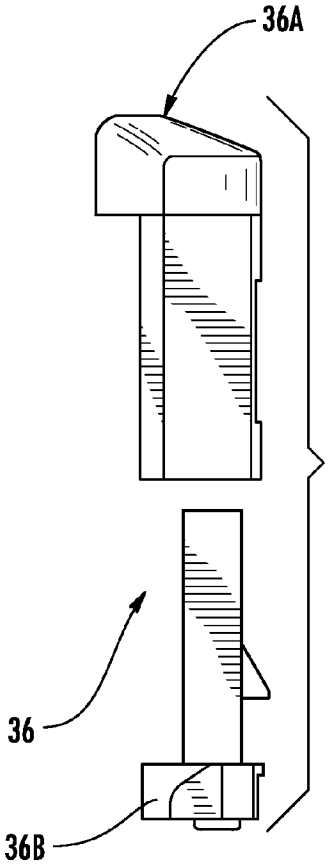
FIG. 13B is an exploded view of the button member of FIG. 12B.
Figure 13A:
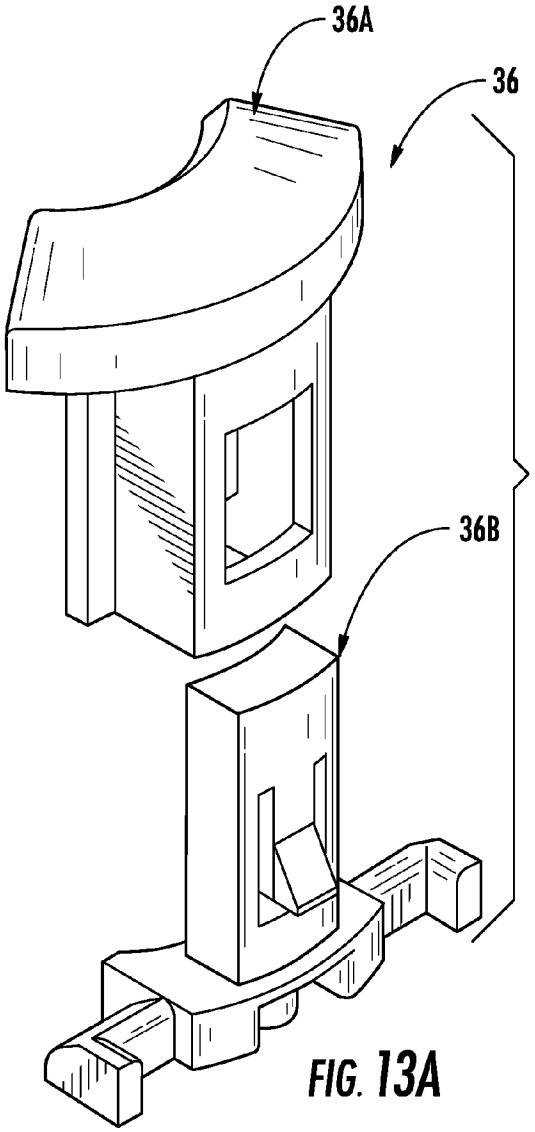
FIG. 13A is an exploded view of the button member of FIG. 12A.
Figure 14A:
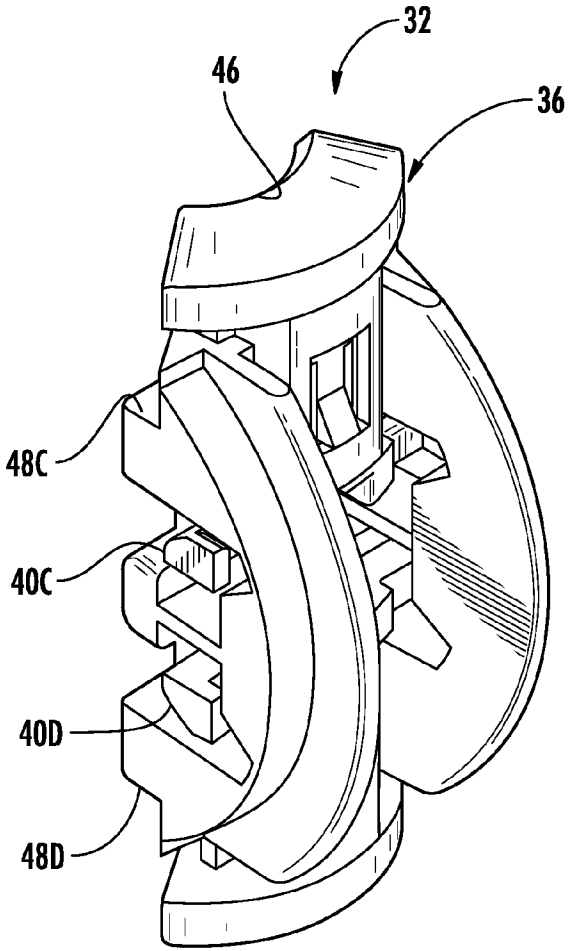
FIG. 14A is a perspective view of a male core member of the male member of FIG. 6.
Figure 14B:
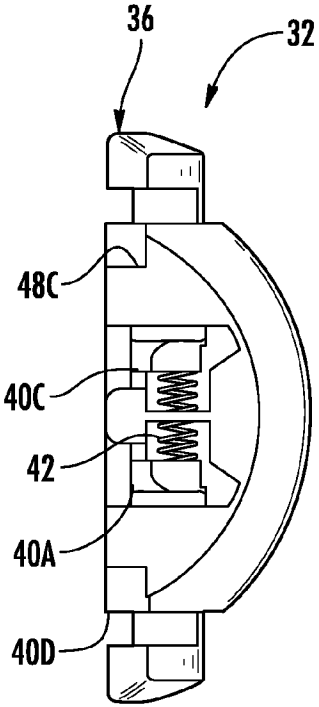
FIG. 14B is a side view of the male core member of FIG. 6.
Figure 14C:
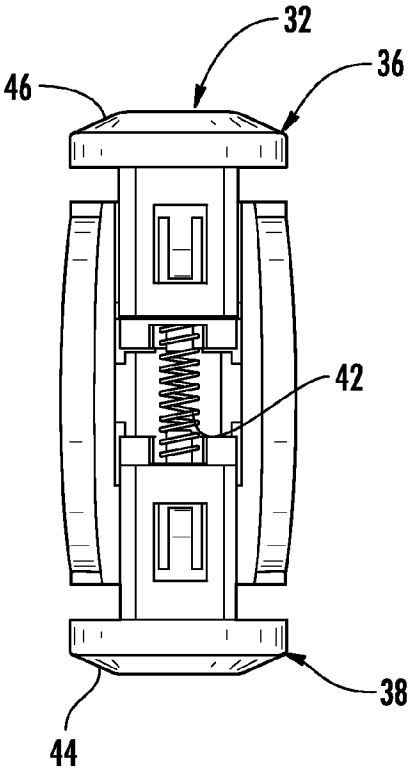
FIG. 14C is a front view of the male core member of FIG. 6.
Figure 15:
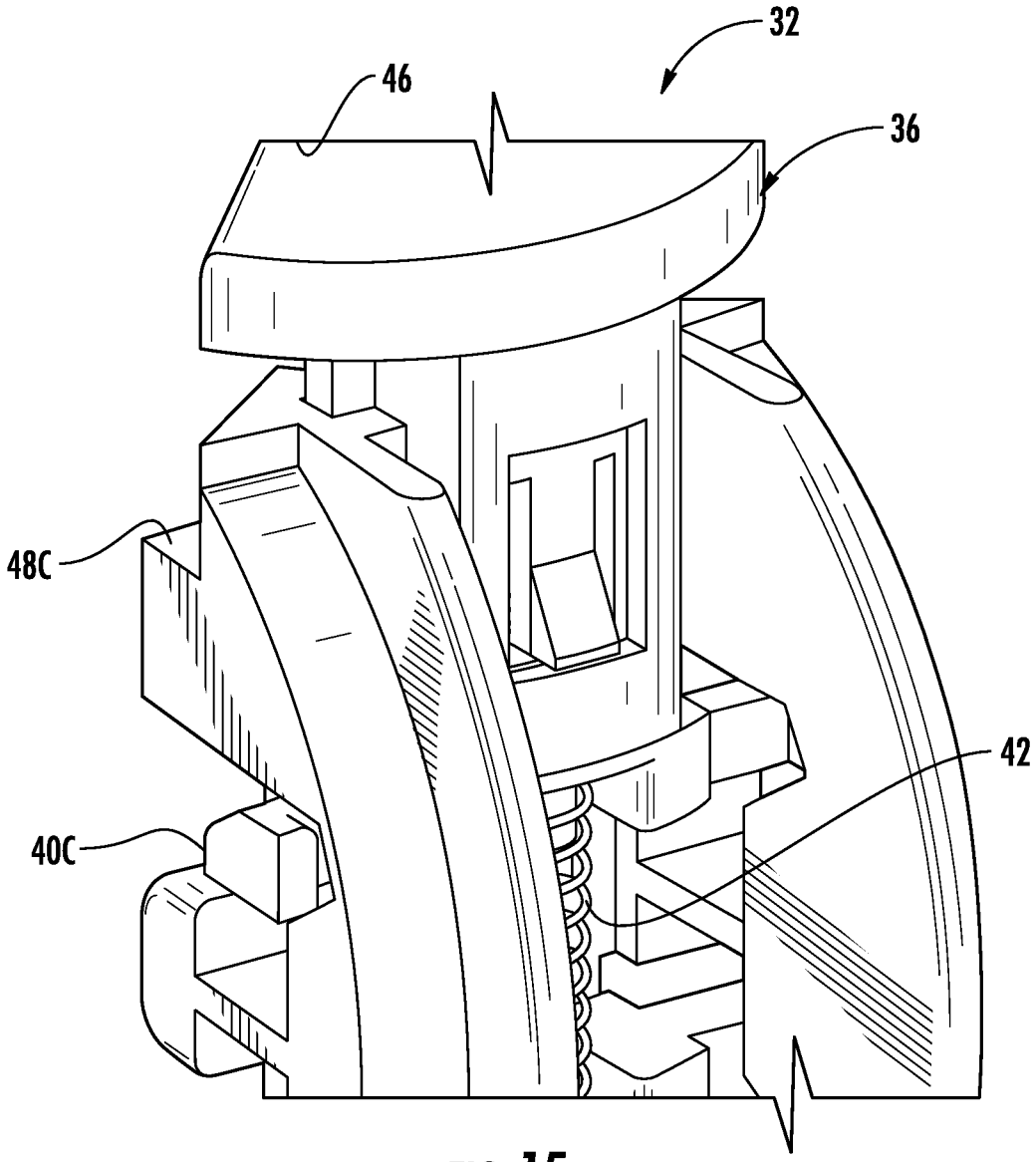
FIG. 15 is a partial view of the male core member of FIG. 14A.
Figure 16C:
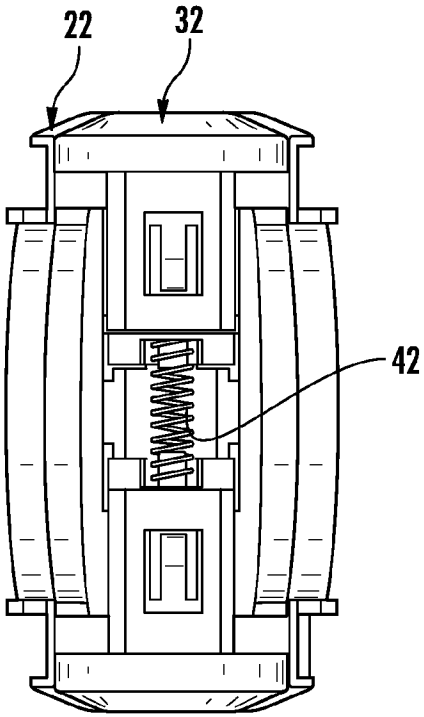
FIG. 16C is a front view of the male core member and the female core member of FIG. 16A.
Figure 16B:
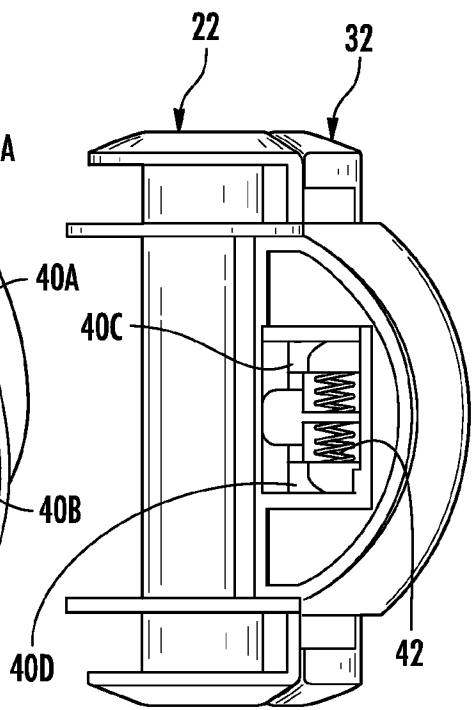
FIG. 16B is a side view of the male core member and the female core member of FIG. 16A.
Figure 16A:
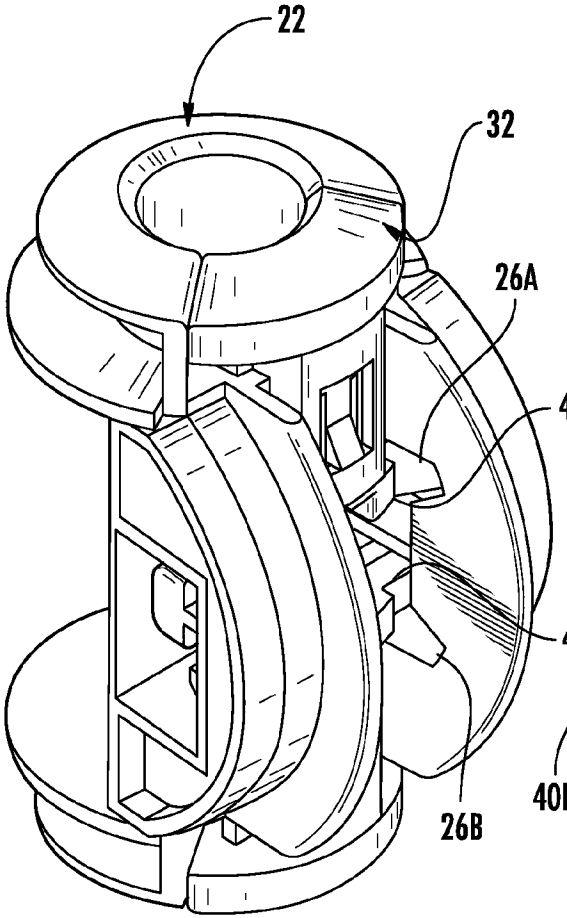
FIG. 16A is a perspective view of the male core member and female core member of FIG. 5 connected together with cushioning removed for illustrative purposes.
Figure 17:
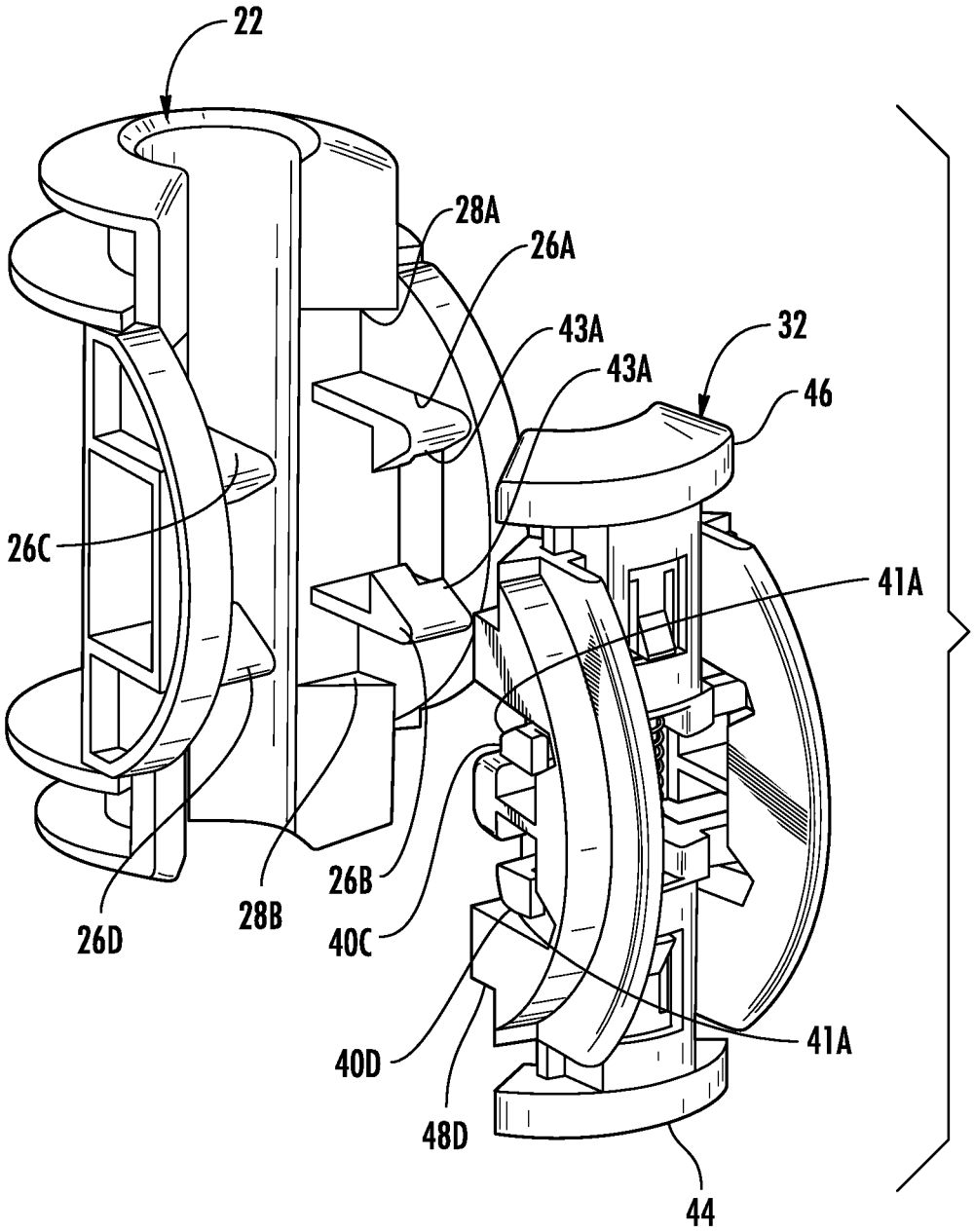
FIG. 17 is an exploded perspective view of the male core and female core member of FIG. 16A.
Figure 18:
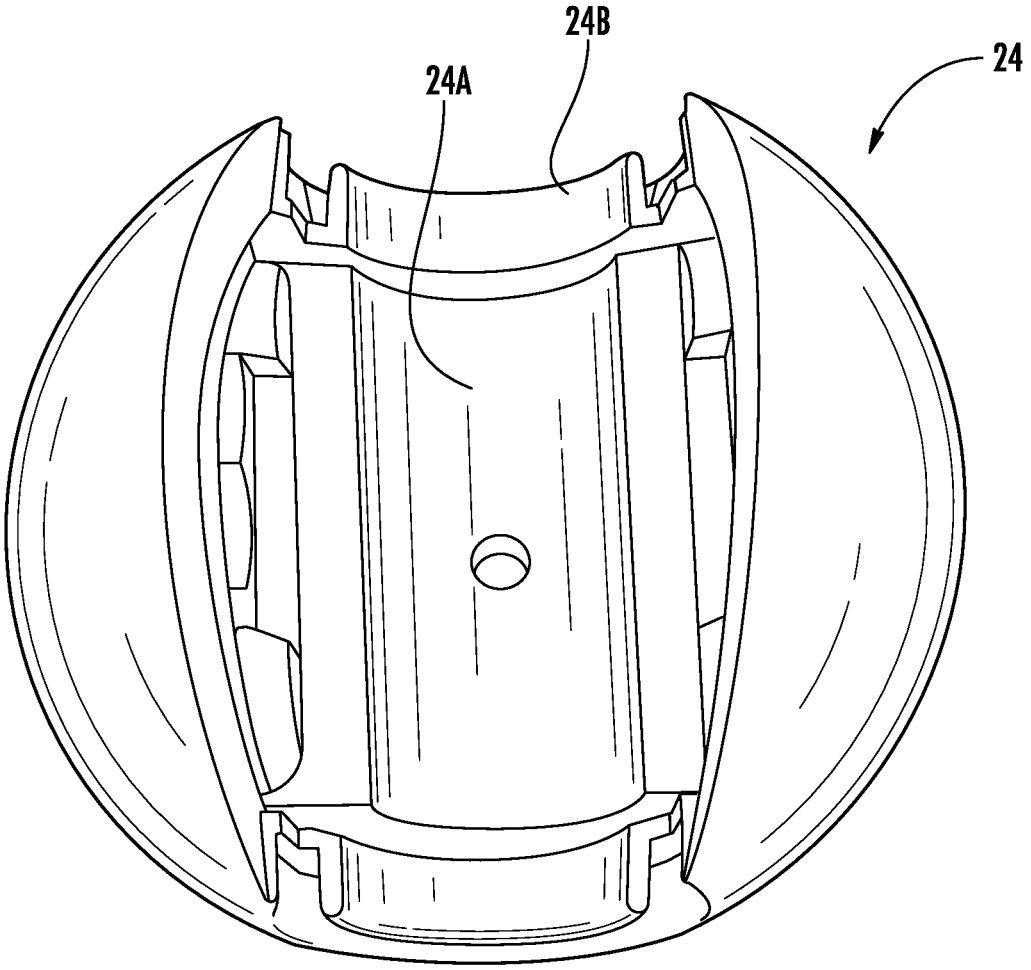
FIG. 18 is a front perspective view of a female cushioning layer of the female member of FIG. 8 with the female core member removed for illustrative purposes.
Figure 19B:
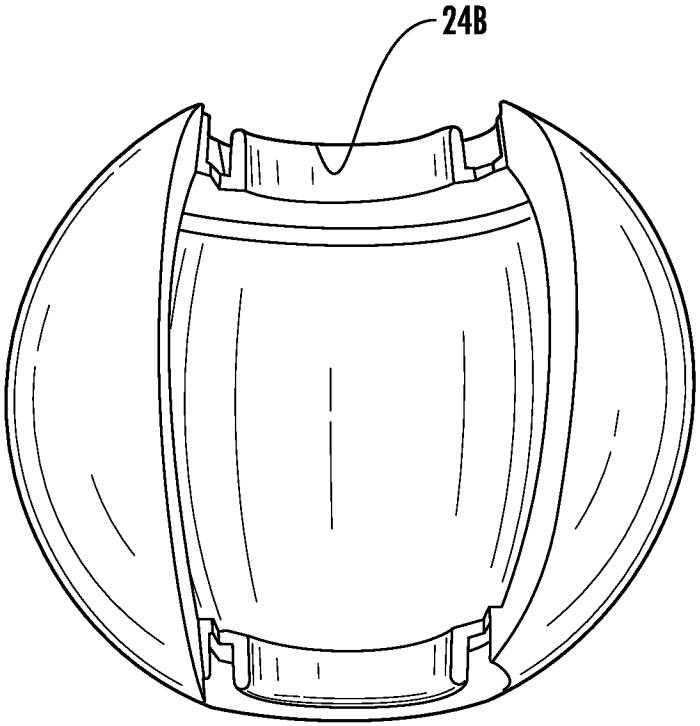
FIG. 19B is a front view of a outer cushioning layer of the female cushioning layer of FIG. 18.
Figure 19A:
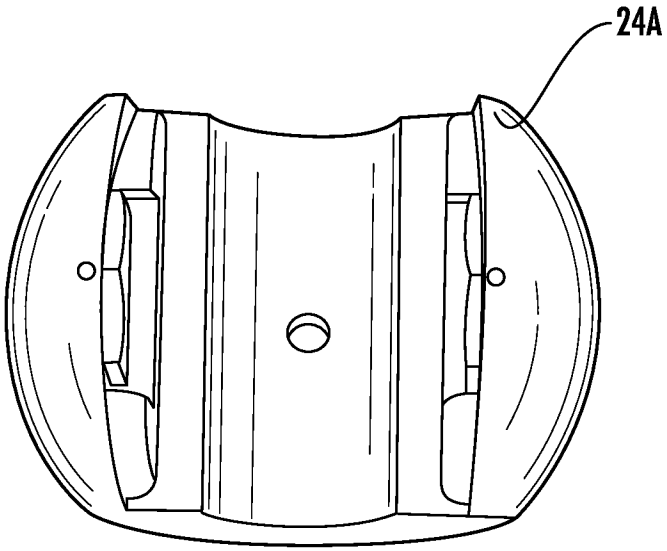
FIG. 19A is a front view of a inner cushioning layer of the female cushioning layer of FIG. 18.
Figure 20B:
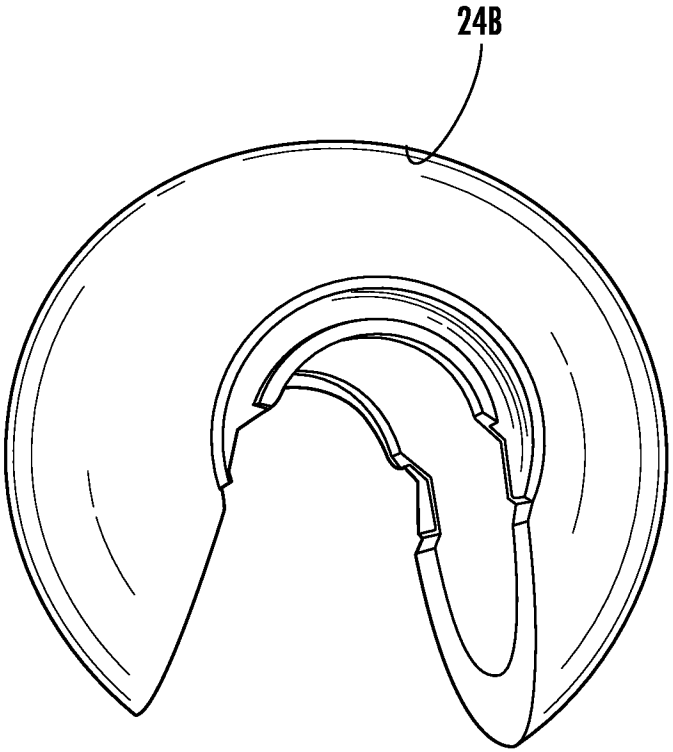
FIG. 20B is a top view of the outer cushioning layer of FIG. 19B.
Figure 20A:
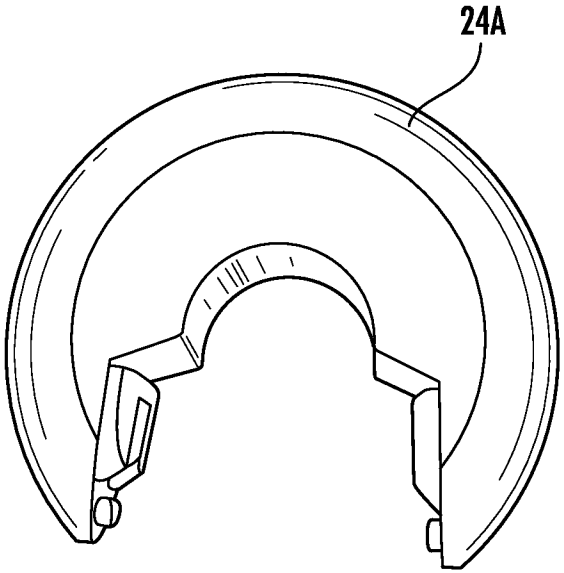
FIG. 20A is a top view of the inner cushioning layer of FIG. 19A.
Figure 21:
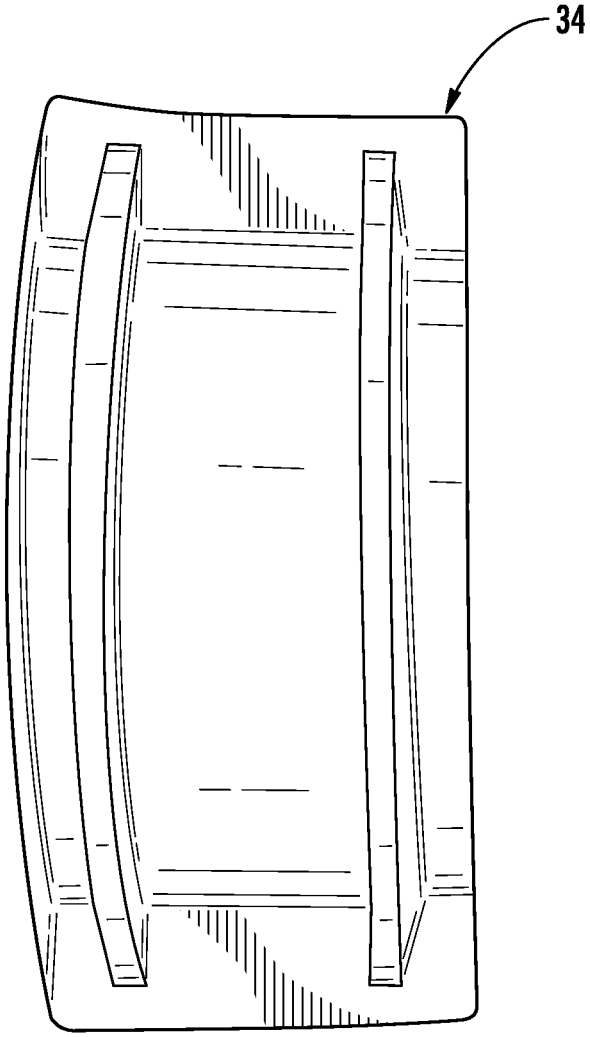
FIG. 21 is a front view of a male cushioning layer for the male member of FIG. 9 with the male core member removed for illustrative purposes.
Figure 22:
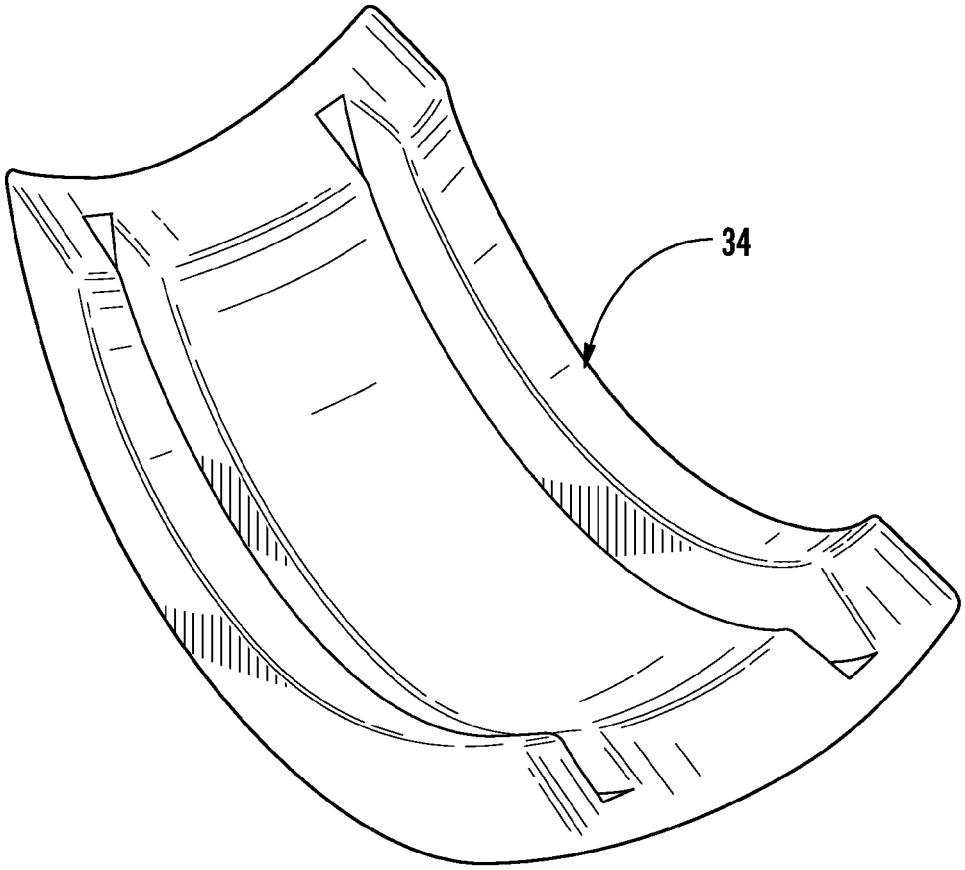
FIG. 22 is a front perspective view of the male cushioning layer of FIG. 21.
Figure 23:
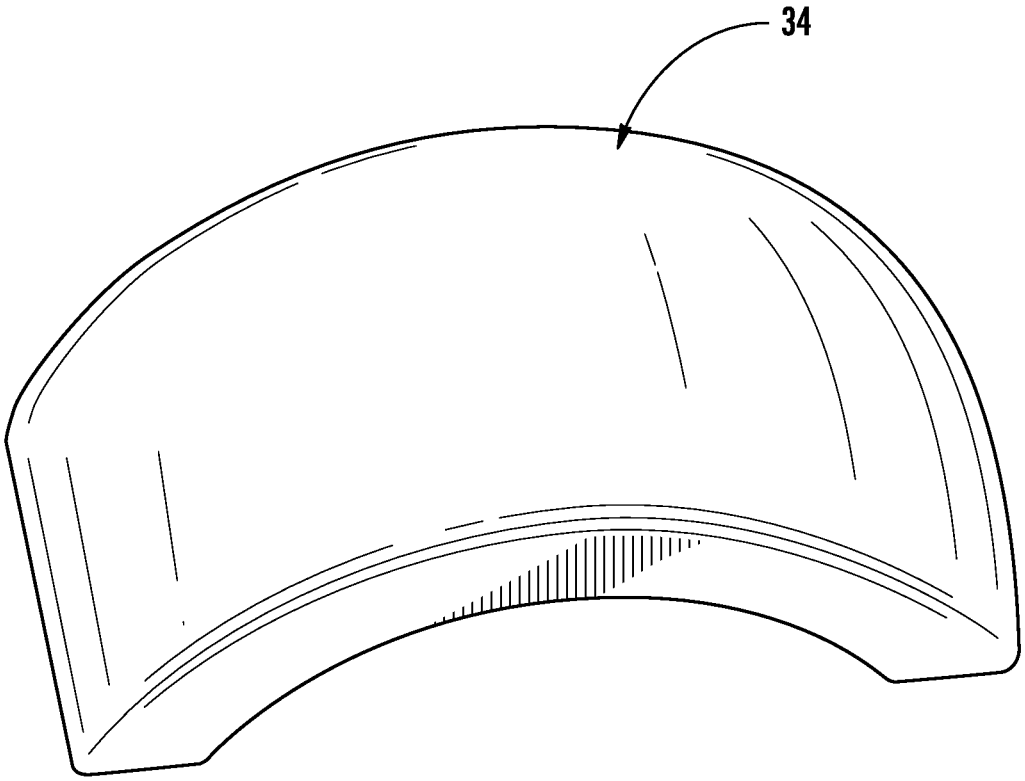
FIG. 23 is a top perspective view of the male cushioning layer of FIG. 21.

Actuation of the target 10 is illustrated generally in FIGS. 10 and 11. The male member core 32 has one or more button members 36, 38 spring-biased by a spring 42 in an outward position as illustrated in FIG. 10. The button members 36, 38 slidably move within opposing ends of the male member 30 from an open position ready to engage corresponding female lock flanges 26A-26D of the female member 20 (FIGS. 10, 14A-C, 15) to a dosed position locking in the corresponding female lock flanges 26A-26D (FIGS. 11, 16A-C) within the male member 30 to prevent horizontal movement. The button members 36, 38 include one or more cam locks 40A-40D configured for releasable engagement with corresponding female lock flanges 26A-26D, as best seen in FIG. 17, to regulate horizontal movement of the male member 30 relative to the female member 20.

The button members 36, 38 have button 44, 46 configured to be depressed to move the cam locks 40A-40D relative to one another to engage or disengage the female lock flanges 26A-26D to regulate the horizontal movement of the male member 30 to the female member 20. When the buttons 44, 46 are depressed against the forces of the spring 42, preferably in unison as seen in FIG. 10, the cam locks 40A-40D move toward each other so the cam locks 40A-40D can clear past free ends of the female lock flanges 26A-26D. This enables the male member core 32 to be separated from the female member core 22 to permit the target 10 to be removed from the strand of the netting. Upon the cam locks 40A-40D disengaging from the female lock flanges 26A-26D, the male member 30 is allowed to horizontally move apart from the female member 20.

For attachment, buttons 44 and 46 can be squeezed to permit easy engagement of the male member 34 to the female member 20. Or, the male member 30 can be simply pressed into the female 30 and the cam locks 40A, 40B will simply cam over female lock flanges 26A-D thereby drawing the buttons 44 and 46 toward each other until the aforesaid clearance occurs in the reverse direction thereby locking the male member 30 to the female member with a strand or strands 500 captured therein.

The male member core 32 also has male surfaces 48A-48D defining a triangular shape for engaging the female surfaces 28A-28D of the female member 20 to prevent vertical movement of the male member 30 relative to the female member 20 when connecting with one another. Once the female lock flanges 26A-26D clear the male cam locks 40A-40D, the male member core 32, the male member 30 and female member 20 are allowed to move both vertically and horizontally relative to one another.

More details of the construction of the male core member and female core member are illustrated in FIGS. 12-17. For example, a spring 42 resides between a first button 36 and a second button 38. For example, FIGS. 12A-12C illustrate an isolated view of a single button 36 having cam locks 40A, 40C. Referring to FIGS. 13A-13C, the single 36, in another example, may comprise two separate pieces 36A, 36B, which permanently snap into one another. This is a manufacturing technique to enable the construction of a piece with a complex geometry that is not easily formed from a single mold or operation. If desired or physically possible, the button 36 can be a unitary body. Optionally, the target 10 may use spring-biased button members 36, 38 that consist of a single piece or more joined together by as variety of methods. The male core member is shown well in FIGS. 14 and 15. The male core member mated or connected to the female core member is shown in FIG. 16.

An exploded view of FIG. 17 provides details concerning how the male core member 22 releasably connects to the female core member 32. The cam locks 40A-40D engage with the female lock flanges 26A-26D on the female core member 32. When the buttons 44, 46 are depressed against the forces of the springs toward each other, the cam locks 40A-40D move towards one another, as in FIG. 11, so they can clear past the free ends of the female lock flanges. This enables the male core member 22 to be separated from the female core member 32 to permit the target 10 to be removed from a length of the netting 50.

For connection of the male member 30 with the female member 20, the button 44, 46 may or may not be depressed. If they are not depressed, angled surfaces 41A of the male cam locks 40A-40D ride on angled surfaces 43A of the female lock flanges 26A-26D to urge the button 44, 46 toward each other on their own. For removal of the male member 30 from the female member 20, the buttons 44, 46 must be depressed toward each other. If there is more than one button, both buttons 44, 46 must be depressed simultaneously for removal of the male member 30 from the female member 20. This provides additional safety to ensure that the target 10 is not accidentally detached from the netting 500 by depression of only one of the buttons 44, 46. Therefore, it is preferred that both buttons 44, 46 must be depressed to detach the male member 30 from the female member 20.

Referring to FIGS. 18-23, the target 10 is preferably configured to be multi-layered. The male core 32 and female core 22 are removed for illustrative purposes in these figures. More specifically, the multi-layered target 10 includes a female core 22 with a dual cushioning layer, generally referred to as 24, of an inner cushioning layer 24A and an outer cushioning later 24B. The male core 32 has a cushioning layer 34. The cushioning layer 24 preferably includes the inner cushioning layer 24A made of polyurethane material that is lightweight. A second cushioning layer 24B preferably include a rubber composition made of resilient material. While these materials are preferred, virtually any type of cushioning material may be employed for this purpose. The outer layer 24, 34 reduces damage to incoming basketballs and deadens the sound of the associated impact. The male and female cushioning layers 34, 24 may include one or more cushioning layers each with different compositions of materials other than rubber composition and polyurethane material. It should be noted that the male and female cushioning layers 34, 24 are is optional and the target 10 may still functional with the male and female layer 34, 24 removed altogether.

Referring to FIG. 24, in operation, the targets 10A-10E including the male and female members 20, 30 are removably connected with one another to engage the strands 500A-500E of the netting within the channel 20A, 30A and prevent movement relative to one another in horizontal or vertical direction until the buttons 44, 46 are depressed. It is possible to attach just one target 10 at any location or more than one target in different locations, the possibility of which is shown in FIG. 24.

The present invention includes a method for improving basketball shooting accuracy of a basketball through a netting 500 of a basketball goal. To start, the target 10 is configured for removably connecting around a strand or strands of netting 500 and routing the strand through an entire length of the target 10. FIG. 24 shows targets 10A, 10B, 10C and 10E attached to a single strand 500, while, for example, target 100 is attached to more than one strand 500 to illustrate a different option for use of the target 10 of the present invention. For example, the target may be the basketball shooting target 10 as described in more detail above. Next, the target 10 is positioned on the netting of the basketball goal at a specified location. The target 10 is connected around the strand, which is routed through the entire length of the target 10. In operation, the target 10 engages the strand or strands 500 of the netting for aiming purposes to assist a basketball shooter in more accurately guiding the basketball through the basketball goal.

It should be noted that the netting could be routed through the target 10 used for aiming a basketball of the present invention in any way desired by the user. Typically, there is netting available at this position to receive the target 10 of the present invention. This netting is knotted a distance from the rim to position the target 10 at a desirably distance below the rim, as shown. With a net that is simply releasably engaged with a hook structure on the rim, it is possible that the desired loop is unhooked and the target 10 routed over the loop and then the loop is re-hooked onto the rim without even removing the male member 30 from the female member 20. If no netting loop is available at the desired twelve o'clock position, two closest loops can be both routed through the channel 20A, 30A of the target 10 of the present invention and then re-hooked on the rim, either in their original hook locations or to the same hook location as each other at twelve o'clock. Such an option to capture more than one strand 500 (although not at the twelve o'clock position) is seen by attachment of target 10D in FIG. 24.

Even if the netting is secured to the rim by a loop and hook configuration, the male member 30 may be removed from the female member 20 and attached directly to the strand of netting in a transverse manner rather than routing a loop of netting through the channel 20A, 30A of the target 10. For netting that is attached by looped netting on hooks on the rim, the present invention provides the user with the flexibility of being able to attach the target 10 either by routing a loop through the channel 20A, 30A or by separating the male member 30 from the female member 20, placing the length of netting therein and then replacing the male member 30. For netting that is securely lashed to a rim, the present invention gives the user the ability to quickly and easily the target 10 without altering the netting itself or untying it from the rim. Therefore, the present invention can provide a target 10 that is suitable for and can accommodate all netting environments.

In summary, the invention is generally directed to the novel and unique basketball shooting target removably connected to a basketball goal. The target 10 includes the female member 20 and the male member core 30. In operation, the male and female members 30, 20 removably connect with one another to engage a netting of a basketball goal and prevent movement relative to one another in horizontal or vertical direction until disengagement.

Therefore, while there is shown and described herein certain specific structure embodying the invention, it will be manifest to those skilled in the art that various modifications and rearrangements of the parts may be made without departing from the spirit and scope the underlying inventive concept and that the same is not limited to the particular forms herein shown and described except insofar as indicated by the scope of the appended claims.

What is claimed is:

1. A basketball shooting target for removably connecting to a netting of a basketball goal, comprising:

an object for aiming a basketball through a basketball goal configured for removably connecting to a strand of the netting; the strand being routed through an entire length of the object and the object being configured for removably connecting around the strand of the netting; the object defining a first aperture for entering the strand into the object and a second aperture for exiting the strand from the object, the object defining a channel running an entire length of the object from the first aperture to the second aperture;

the object being multi-layered, spherical in shape and including at least one cushioning layer; the object including a female member having a female core and a female outer layer and a male member having a male core and a male outer layer;

whereby the object is positioned at a specific location on the netting to provide a basketball shooting target for training purposes.

2. The basketball shooting target of claim 1, wherein the female core has one or more female contact members of a triangular shape; and wherein the male core has male contact member of a triangular shape, substantially complementary to the triangular shape of the female contact members, for engaging the female core member to prevent vertical movement of the male and female member relative to another upon engagement thereof.

3. The basketball shooting target of claim 2, further comprising:

the female member core having one or more female lock flanges to prevent horizontal movement upon engagement with the male member core; and the male member core having a cam lock members configured for respective releasable engagement with the female lock flanges to regulate horizontal movement of the male member relative to the female member.

4. The basketball shooting target of claim 3, wherein the cam lock members are configured for releasable engagement with corresponding the female lock flanges.

5. The basketball shooting target of claim 4, wherein the cam lock members are spring-biased to facilitate engagement and disengagement with the female lock flanges.

6. The basketball shooting target of claim 5, wherein a plurality of buttons are respectively connected to the cam lock members; the buttons being configured to be depressed to allow free connection and disconnection of the male member to the female member.

7. A basketball shooting target for connecting with a netting of a basketball goal, comprising:

an object for aiming a basketball through a basketball having a female member removably connecting to a male member to secure at least one strand of the netting with a channel defined therein;

the female member having a female core member and a female outer layer;

the female core member having one or more female lock flanges for preventing horizontal movement of the female member relative to a male member upon connecting, a female core member having one or more female contact surfaces to prevent vertical movement of the female member relative to the male member upon connecting;

the female outer layer having one or more cushioning layers attached to an outer surface of the female core member to reduce damage to basketballs and deaden sound; and the male member having a male core member and a male outer layer;

the male core member having at least one button; the buttons having one or more cam locks configured for releasable engagement with the female lock flanges to prevent horizontal movement, the male member core having male contact surfaces for engaging the female contact surfaces of the female member to prevent vertical movement;

the male outer layer having one or more cushioning layers attached to an outer surface of the male core member, whereby male and female members removably connect with one another to engage a netting of a basketball goal and prevent movement relative to one another in horizontal or vertical direction upon connecting.

8. A basketball shooting target for connecting with a netting of a basketball goal, comprising:

an object for aiming a basketball through a basketball having a female member removably connecting to a male member, the object defining a channel through an entire length of the male and female member configured to receive at least one strand of the netting;

the female member having a female core member and a female outer layer;

the female core member having one or more female lock flanges for preventing horizontal movement of the female member relative to a male member upon connecting, a female core member having one or more female contact surfaces defining a triangular shape to prevent vertical movement of the female member relative to the male member upon connecting;

the female outer layer having one or more cushioning layers attached to an outer surface of the female core member to reduce damage to basketballs and deaden sound; and the male member having a male core member and a male outer layer;

the male core member having one or more spring-biased button members slidably connecting within one or more opposing ends of the male member, the button members having one or more cam locks configured for releasable engagement with the female lock flanges to regulate horizontal movement of the male member relative to the female member, the button members having button surfaces configured to be depressed to move the cam locks relative to one another to engage or disengage the female lock flanges to regulate the horizontal movement of the male member to the female member, the male member core having male contact surfaces defining a triangular shape for engaging the female contact surfaces of the female member to prevent vertical movement;

the male outer layer having one or more cushioning layers attached to an outer surface of the male core member, whereby male and female members removably connect with one another to engage a netting of a basketball goal and prevent movement relative to one another until depression of the button surfaces.

9. A method for improving basketball shooting accuracy of a basketball into a netting of a basketball goal, comprising:

providing an object configured for removably connecting around a strand of the netting and routing the strand through a channel defined through an entire length of the object to receive the strand; the object including a female member having a female core member and a female outer layer; the female core member having one or more female lock flanges for preventing horizontal movement of the female member relative to a male member upon connecting, a female core member having one or more female contact surfaces to prevent vertical movement of the female member relative to the male member upon connecting; the female outer layer having one or more cushioning layers attached to an outer surface of the female core member to reduce damage to basketballs and deaden sound; and a male member having a male core member and a male outer layer; the male core member having one or more button members, the button hook members having one or more cam locks configured for releasable engagement with the female lock flanges to prevent horizontal movement the male member core having male contact surfaces for engaging the female contact surfaces of the female member to prevent vertical movement; and the male outer layer having one or more cushioning layers attached to an outer surface of the male core member;

positioning the object about the netting of the basketball goal; and connecting the object to the strand of the netting of a basketball goal; and whereby the object engages the strand of the netting for aiming purposes to assist a basketball shooter in more accurately guiding the ball through the basketball goal.

* * * * *